US011503881B2

(12) United States Patent
Moore

(10) Patent No.: US 11,503,881 B2
(45) Date of Patent: Nov. 22, 2022

(54) SHOE SIZERS FOR CHILDREN

(71) Applicant: Jill Moore, Cedar Park, TX (US)

(72) Inventor: Jill Moore, Cedar Park, TX (US)

(73) Assignee: MOORE LLC, Cedar Park, TX (US)

( * ) Notice: Subject to any disclaimer, the term of this patent is extended or adjusted under 35 U.S.C. 154(b) by 0 days.

(21) Appl. No.: 17/169,270

(22) Filed: Feb. 5, 2021

(65) Prior Publication Data

US 2021/0186162 A1 Jun. 24, 2021

Related U.S. Application Data

(63) Continuation-in-part of application No. 16/170,326, filed on Oct. 25, 2018, now Pat. No. 10,925,351.

(51) Int. Cl.
*A43D 1/02* (2006.01)

(52) U.S. Cl.
CPC ..... *A43D 1/027* (2013.01)

(58) Field of Classification Search
CPC ..... A43D 1/027; G09B 19/00; A43B 3/30
See application file for complete search history.

(56) References Cited

U.S. PATENT DOCUMENTS

| | | | |
|---|---|---|---|
| 1,252,920 A | 1/1918 | Maine | |
| 3,359,640 A | 12/1967 | Kirkland | |
| 4,136,452 A | 1/1979 | McMillan | |
| 4,995,514 A | 2/1991 | Forschner | |
| D366,624 S | 1/1996 | Collins | |
| 5,879,725 A | 3/1999 | Potter | |
| 5,914,659 A | 6/1999 | Herman et al. | |
| D419,080 S | 1/2000 | Panek | |
| 6,029,358 A | 2/2000 | Mathiasmeier et al. | |
| 6,055,738 A | 5/2000 | Bardeen | |
| 7,069,665 B1 | 7/2006 | Adriano | |
| 7,121,019 B2 | 10/2006 | Frederiksen et al. | |
| 7,752,769 B1 | 7/2010 | Cheh | |
| 7,770,301 B1 | 8/2010 | Grandberry et al. | |
| 7,854,071 B2 | 12/2010 | Goonetilleke et al. | |
| 7,882,645 B2 | 2/2011 | Boring | |
| D704,080 S | 5/2014 | Carabajal et al. | |
| 10,925,351 B2 * | 2/2021 | Moore | G09B 19/00 |
| 2002/0035793 A1 | 3/2002 | Byrd | |

(Continued)

FOREIGN PATENT DOCUMENTS

| | | |
|---|---|---|
| GB | 2020832 A | 11/1979 |
| WO | 2001093712 A1 | 12/2001 |
| WO | 2006052260 A1 | 5/2006 |

*Primary Examiner* — Yaritza Guadalupe-McCall
(74) *Attorney, Agent, or Firm* — Loza & Loza LLP

(57) ABSTRACT

A child's shoe sizing kit, system, and method are disclosed. The kit includes a variety of shoe sizers, or cut out templates of a foot sized in a variety of sizes. The kit includes whole and half sizes shoe sizers for: Infant, Baby Walker, Toddler, Little Kid, and Big Kid. The kit would have the size on each sizer also marked with Left and Right. Each kit of sizers would come in a small clear carrying bag with handle for easy transport to stores. The child steps down on the sizers to determine which size the child's foot is. Select the sizer which fits the size and shape of the child's foot. Take the correct sizer that matches the child's foot and place it inside of a shoe. Place your hand in the shoe to feel where the sizer ends compared to where the shoe ends.

20 Claims, 15 Drawing Sheets

(56) References Cited

U.S. PATENT DOCUMENTS

| | | | | |
|---|---|---|---|---|
| 2003/0057025 | A1* | 3/2003 | Cagner | A43D 1/02 186/52 |
| 2012/0079738 | A1 | 4/2012 | Alberi | |
| 2013/0337424 | A1* | 12/2013 | Selix | A43B 23/24 434/267 |
| 2015/0019372 | A1 | 1/2015 | Fox | |
| 2017/0231320 | A1 | 8/2017 | Nunez et al. | |
| 2020/0128920 | A1 | 4/2020 | Moore | |
| 2020/0315287 | A1* | 10/2020 | Benincasa | A43B 7/28 |
| 2021/0186162 | A1* | 6/2021 | Moore | A43D 1/027 |

* cited by examiner

SHOE SIZERS FOR CHILDREN

CROSS-REFERENCE TO RELATED PATENT APPLICATIONS

This application is a Continuation in Part of U.S. application Ser. No. 16/170,326, entitled "SHOE SIZERS FOR CHILDREN," filed on Oct. 25, 2018. Application Ser. No. 16/170,326 is incorporated herein by reference in its entirety.

TECHNICAL FIELD

Embodiments are generally related to shoe sizers for children. Embodiments are additionally related to a kit for determining a child's shoe size. Embodiments also relate to a method for determining the proper size of a child's foot.

BACKGROUND

Shoes sizes are not universal and vary from different manufacturers. Some manufacturers place emphasis on different anatomical measurements such as ball girth, instep, waist and length. Most manufacturers continue to use their own sizing scales, thus resulting in inconsistent and subjective shoe sizes.

An ideal fit cannot always be guaranteed by way of conventional shoe sizing scales. Most shoes are manufactured in mass quantities and shipped to stores that stock each shoe in a variety of sizes. At the store, the length and width of the wearer's foot is often measured with a Brannock shoe measurement tray to determine a nominal foot size. The Brannock shoe measurement device measures the length of the foot in half size increments, from size 1 to size 15½. Each half size increment is equal to ⅙". Width designations are provided on a scale of letters incremented by ⅙, e.g., AAA, AA, A, B, C, D, E, EE, and EEE. Moreover, shoes are conventionally sold in matched pairs, despite the fact that many people have differing sizes in their left and right feet. Any size provided by such a measuring device is an estimate and not standard across all shoes.

When the shoe wearer is a child, he or she often is unaware of proper shoe fit. Children often do not realize that they are wearing shoes that are too tight because they outgrow their shoes very quickly. Although parents may take their child to a shoe store to find larger shoes, the child does not always cooperate. It may take many attempts of trying various shoes before finding a properly fitting pair. When asked the subjective question—"how does that shoe fit?"—a child may respond with inaccurate information. The child may not have the experience to judge the proper fit of their shoes.

Children's feet can grow quickly and at an irregular rate. Shoes that once fit the child a few weeks or months ago may no longer fit them. Children's feet can sustain long-term damage by wearing improperly-fitted shoes. Often times, children are unaware their shoes no longer fit. They fail to tell their parents about the improper fit, instead opting to continue wearing the small shoes. It is problem for a parent to know when it is necessary to buy a larger pair of shoes for a child. Usually, adults can determine the fit of their child's shoes by pressing the toe boxes to see if room exists in that area. This determination is often inaccurate especially with stiff shoes.

In failed attempts to address these issues, footwear designers try to improve the fit of footwear by providing customized footwear items. Some customizable footwear has been made using molds taken of the foot of the wearer. Producing a shoe from these molds is time-consuming, expensive, and often results in shoes that are too tight. Another type of customizable footwear approach has been developed using digital imaging technology, which requires expensive and highly-specialized equipment that is not available to the general public. It is a principal object of the present invention to provide a system and method for fitting footwear that avoids the drawbacks of these approaches.

Accordingly, the present invention provides a shoe sizing kit, system, and method which serves as an objective guide to a child's foot size for proper shoe fitting.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, an aspect of the disclosed embodiments to provide shoe sizers for children.

In addition, it is aspect of the embodiments to provide a kit for determining a child's shoe size.

It is another aspect of the disclosed embodiments to provide a method for determining the proper size of a child's foot.

The aforementioned aspects and other objectives and advantages can now be achieved as described herein. In the disclosed embodiments, a child's shoe sizing kit, system, and method are disclosed. The kit includes a variety of shoe sizers, or cut out templates of a foot sized in a variety of sizes. The kit includes whole and half sizes shoe sizers for: Infant, Baby Walker, Toddler, Little Kid, and Big Kid. The kit would have the size on each sizer also marked with Left and Right. Each kit of sizers would come in a small clear carrying bag with handle for easy transport to stores. The child steps down on the sizers to determine which size the child's foot is. Select the sizer which fits the size and shape of the child's foot. Take the correct sizer that matches the child's foot and place it inside of a shoe. Place your hand in the shoe to feel where the sizer ends compared to where the shoe ends.

In one aspect, a shoe sizing kit is disclosed. The shoe sizing kit comprises: a plurality of shoe sizers shaped in a plurality of shoe sizes and shaped to size a foot; instructions for using the plurality of shoe sizers; and a carrying container for the plurality of shoe sizers and the instructions. In yet another aspect, the plurality of shoe sizers are shaped to measure a foot size of a child.

In other aspects, the plurality of shoe sizers comprises seven sizers, wherein the plurality of shoe sizers are shaped to measure a foot size of an infant, wherein the plurality of shoe sizers are shaped in infant shoe sizes: 0, 1, 1.5, 2, 2.5, 3, 3.5. In an aspect, the plurality of shoe sizers comprises seven sizers, wherein the plurality of shoe sizers are shaped to measure a foot size of a baby walker, wherein the plurality of shoe sizers are shaped in baby walker shoe sizes: 4, 4.5, 5, 5.5, 6, 6.5, 7. In some aspects, the plurality of shoe sizers comprises eleven sizers, wherein the plurality of shoe sizers are shaped to measure a foot size of a toddler, wherein the plurality of shoe sizers are shaped in toddler shoe sizes: 7, 7.5, 8, 8.5, 9, 9.5, 10, 10.5, 11, 11.5, 12. In another aspect, the plurality of shoe sizers comprises seven sizers, wherein the plurality of shoe sizers are shaped to measure a foot size of a little kid, wherein the plurality of shoe sizers are shaped in little kid shoe sizes: 12, 12.5, 1, 1.5, 2, 2.5, 3. In other aspects, the plurality of shoe sizers comprises nine sizers, wherein the plurality of shoe sizers are shaped to measure a foot size of a big kid, wherein the plurality of shoe sizers are shaped in big kid shoe sizes: 3, 3.5, 4, 4.5, 5, 5.5, 6, 6.5, 7.

In yet another aspect, the plurality of shoe sizers are marked on one side with "Left" to measure a left foot; and the plurality of shoe sizers are marked on one side with "Right" to measure a right foot. In other aspects, the plurality of sizers comprise at least one of: foam, foam rubber, polymer, plastic, or paper. In some aspects, the instructions for using the plurality of shoe sizers advise: select one of the plurality of sizers that corresponds to a size of a right foot of a child; have the child step down with the right foot on one of the plurality of sizers to determine a size of the right foot of the child; turn over the one of the plurality of sizers to measure a left foot or select another one of the plurality of sizers that corresponds to a size of the left foot of the child; have the child step down with the left foot on one of the plurality of sizers to determine a size of the left foot of the child; insert the selected one of the plurality of sizers into a shoe to determine if the shoe fits the right foot of the child, wherein the shoe fits the right foot if the selected one of the plurality of sizers does not touch the end of the shoe; insert the selected one of the plurality of sizers into a shoe to determine if the shoe fits the left foot of the child, wherein the shoe fits the left foot if the selected one of the plurality of sizers does not touch the end of the shoe; select the shoe for the right foot if the one of the plurality of sizes fits with space between the one of the plurality of sizers and the end of the shoe; and select the shoe for the left foot if the one of the plurality of sizes fits with space between the one of the plurality of sizers and the end of the shoe.

In another aspect, the carrying container comprises a package, a plastic bag, a box, or a bag with a handle.

In an aspect, a shoe sizing system comprises: a plurality of shoe sizers shaped in a plurality of shoe sizes and shaped to size a foot a plurality of shoe sizers shaped in a plurality of shoe sizes and shaped to size a foot of a child; and a shoe that receives one of the plurality of shoe sizers when inserted into the shoe, wherein the one of the plurality of shoe sizers corresponds to a size of a foot of the child and correctly determines if the shoe fits the foot of the child.

In some aspects, the plurality of shoe sizers comprises seven sizers, wherein the plurality of shoe sizers shaped to measure a foot size of an infant, wherein the plurality of shoe sizers are shaped in infant shoe sizes: 0, 1, 1.5, 2, 2.5, 3, 3.5. In another aspect, the plurality of shoe sizers comprises seven sizers, wherein the plurality of shoe sizers are shaped to measure a foot size of a baby walker, wherein the plurality of shoe sizers are shaped in baby walker shoe sizes: 4, 4.5, 5, 5.5, 6, 6.5, 7. In other aspects, the plurality of shoe sizers comprises eleven sizers, wherein the plurality of shoe sizers are shaped to measure a foot size of a toddler, wherein the plurality of shoe sizers are shaped in toddler shoe sizes: 7, 7.5, 8, 8.5, 9, 9.5, 10, 10.5, 11, 11.5, 12. In yet another aspect, the plurality of shoe sizers comprises seven sizers, wherein the plurality of shoe sizers are shaped to measure a foot size of a little kid, wherein the plurality of shoe sizers are shaped in little kid shoe sizes: 12, 12.5, 1, 1.5, 2, 2.5, 3. In other aspects, the plurality of shoe sizers comprises nine sizers, wherein the plurality of shoe sizers are shaped to measure a foot size of a big kid, wherein the plurality of shoe sizers are shaped in big kid shoe sizes: 3, 3.5, 4, 4.5, 5, 5.5, 6, 6.5, 7.

In other aspects, the plurality of shoe sizers are marked on one side with "Left" to measure a left foot; the plurality of shoe sizers are marked on one side with "Right" to measure a right foot; and the plurality of sizers comprise at least one of: foam, foam rubber, polymer, plastic, or paper.

In an aspect, a shoe sizing method is disclosed. The method comprises: selecting one of the plurality of sizers that corresponds to a size of a right foot of a child; having the child step down with the right foot on one of the plurality of sizers to determine a size of the right foot of the child; turning over the one of the plurality of sizers to measure a left foot or select another one of the plurality of sizers that corresponds to a size of the left foot of the child; and having the child step down with the left foot on one of the plurality of sizers to determine a size of the left foot of the child.

In another aspect, the method comprises: inserting the selected one of the plurality of sizers into a shoe to determine if the shoe fits the right foot of the child, wherein the shoe fits the right foot if the selected one of the plurality of sizers does not reach a toe touch the end of the shoe; inserting the selected one of the plurality of sizers into a shoe to determine if the shoe fits the left foot of the child, wherein the shoe fits the left foot if the selected one of the plurality of sizers does not touch the end of the shoe; selecting the shoe for the right foot if the one of the plurality of sizes fits within the shoe with space between the one of the plurality of sizers and the end of the shoe; and selecting the shoe for the left foot if the one of the plurality of sizes fits within the shoe with space between the one of the plurality of sizers and the end of the shoe.

BRIEF DESCRIPTION OF THE FIGURES

The accompanying figures, in which like reference numerals refer to identical or functionally-similar elements throughout the separate views, which are incorporated in and form a part of the specification, further illustrate the embodiments and, together with the detailed description, serve to explain the embodiments disclosed herein.

DETAILED DESCRIPTION

Figure 1:
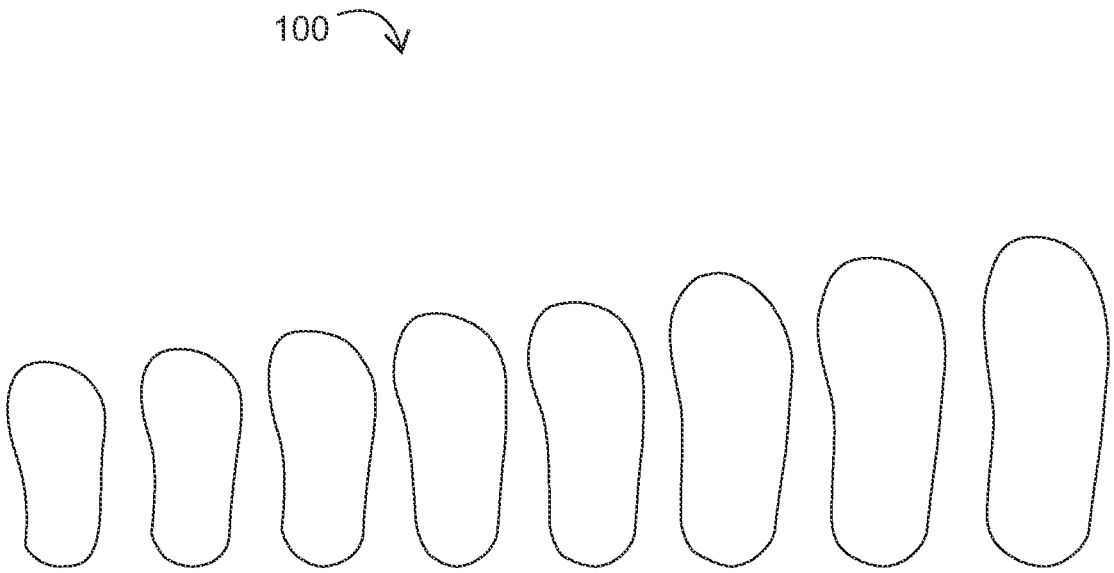
FIG. 1 illustrates a variety of shoe sizers 100, which can be implemented in accordance with an example embodiment.

The particular values and configurations discussed in the following non-limiting examples can be varied, and are cited merely to illustrate one or more embodiments, and are not intended to limit the scope thereof.

Example embodiments will now be described more fully hereinafter, with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

Figure 2:
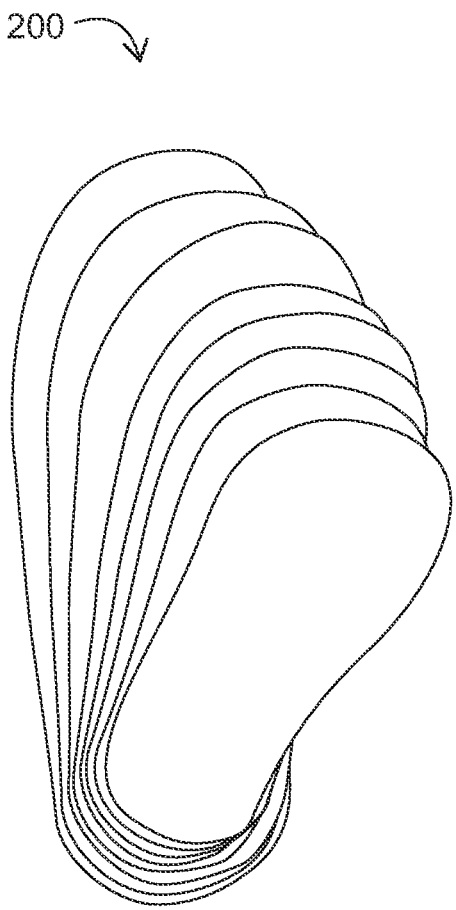
FIG. 2 illustrates a collection of shoe sizers 200 for inclusion in a shoe sizing kit, in accordance with an example embodiment.
Figure 3:
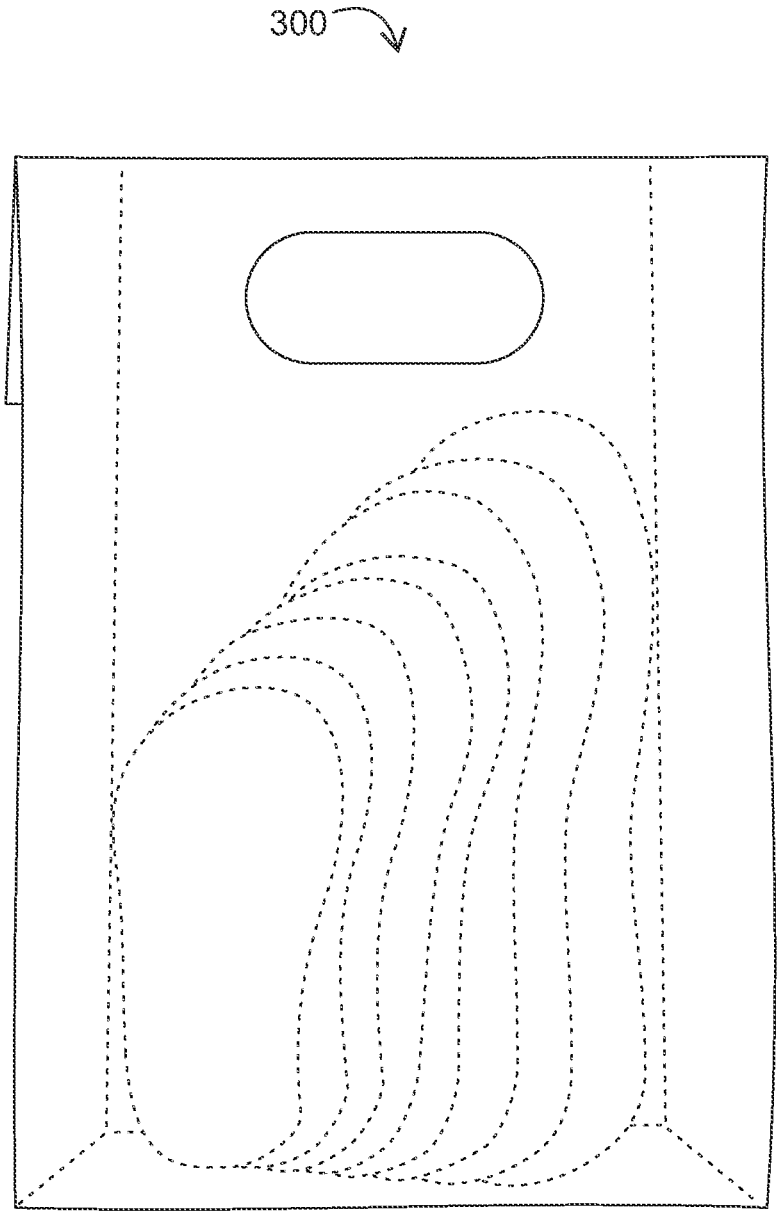
FIG. 3 illustrates the shoe sizer kit 300, in accordance with an example embodiment.
Figure 4:
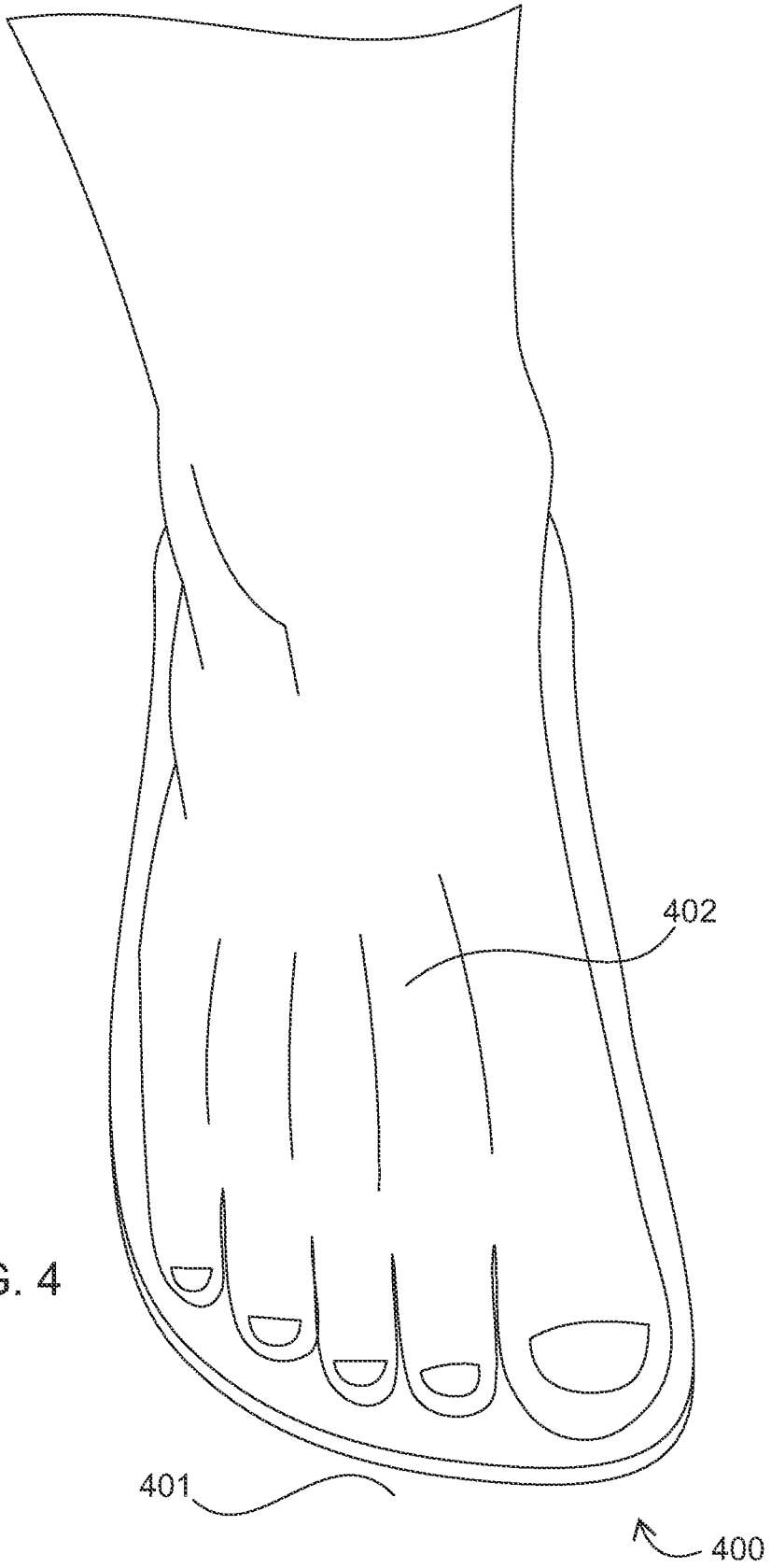
FIG. 4 illustrates the method of using 400 the shoe sizer kit, in accordance with an example embodiment.
Figure 5:
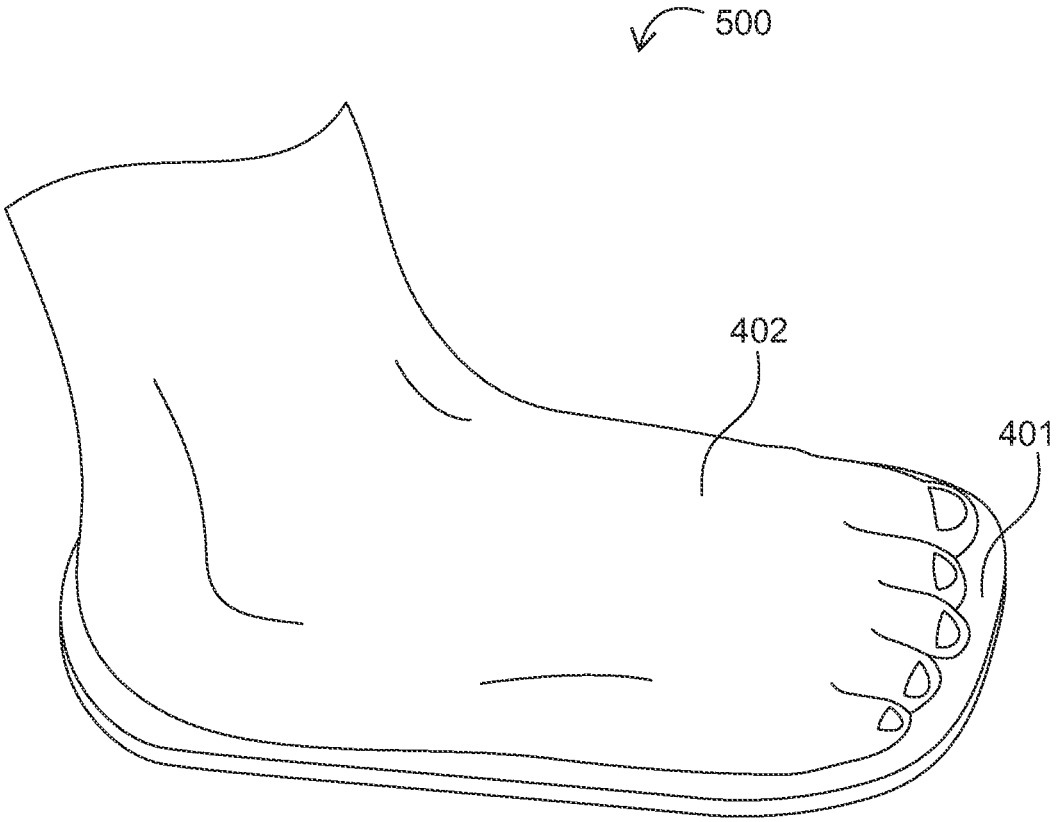
FIG. 5 illustrates the method of using 500 the shoe sizer kit, in accordance with an example embodiment.

The disclosed shoe sizing kit, system, and method helps size a child's foot. The kit includes shoe sizers 100 (as shown in FIG. 1) in a variety of shoe sizes along with instructions on properly sizing a child's foot. The shoe sizers 100 can be constructed of durable material such as, for example, foam, foam rubber, polymer, plastic, or paper. This shoe sizing kit comes in five packages with all whole and half sizes in each package. In certain embodiments, the kit can also comprise a set of wide shoe sizers, a set of regular width shoe sizers, and a set of narrow shoe sizers. The kit includes shoe sizers 200 (as shown in FIG. 2) for: Infant, Baby Walker, Toddler, Little Kid, and Big Kid. Sizes for Infant sizers include (United States Sizes): 0, 1, 1.5, 2, 2.5, 3, 3.5. Sizes for Baby Walker sizers include (United States Sizes): 4, 4.5, 5, 5.5, 6, 6.5, 7. Sizes for Toddler sizers include (United States Sizes): 7, 7.5, 8, 8.5, 9, 9.5, 10, 10.5, 11, 11.5, 12. Sizes for Little Kid sizers include (United States Sizes): 12, 12.5, 1, 1.5, 2, 2.5, 3. Sizes for Big Kid sizers include (United States Sizes): 3, 3.5, 4, 4.5, 5, 5.5, 6, 6.5, 7. The kit would have the size on each sizer also marked with L (Left) and R (Right). Each kit of sizers 300 would come in a carrying container, preferably a small clear carrying bag with handle for easy transport to stores, as illustrated in FIG. 3. The carrying container can also include: a package, a plastic bag, a box, or a bag with a handle.

In certain embodiments, the shoe sizers 100 can be selected to be formed of a clear material such as clear plastic. In other embodiments, the shoe sizer 100 can be formed of rubber, felt, foam, leather, silicone, or plastic. The material can be selected to accept markings from, for example dry erase marker, chalk, etc., so that non-permanent markings can be made on the shoe sizer 100. In still other embodiments, the sizers 100 can be formed of layers of the aforementioned material. For example, in certain embodiments, each sizer 100 can comprise a layer of plastic or polymer, covered by a layer of felt.

A parent or anyone who wishes to size a child's foot can purchase a kit 300 with the appropriate sizers included. The instructions for the shoe sizing kit describe the following process, as illustrated in methods 400-900 illustrated in FIGS. 4-9 included herein.

Remove sizers 200 from packaging. Start with the largest sizer 200 first and work your way down in size. Place a sizer 401 on the floor and have your child step on the sizer 401 (as illustrated in methods 400 and 500 in FIGS. 4 and 5, respectively), lining their foot 402 up with the heal first and see where your child's big toe ends on the sizer 401. If the sizer 401 is too big, then repeat the process until your child's big toe is close enough to the end of the sizer 401. Allow a small space on the end of the sizer 401 at the big toe but not too much space to wear if the sizer 401 is too large. The best fit of a particular sizer 401 would be to have the big toe ½ an inch from the top of the sizer 401 while standing on it upright with the foot 402.

Figure 6:
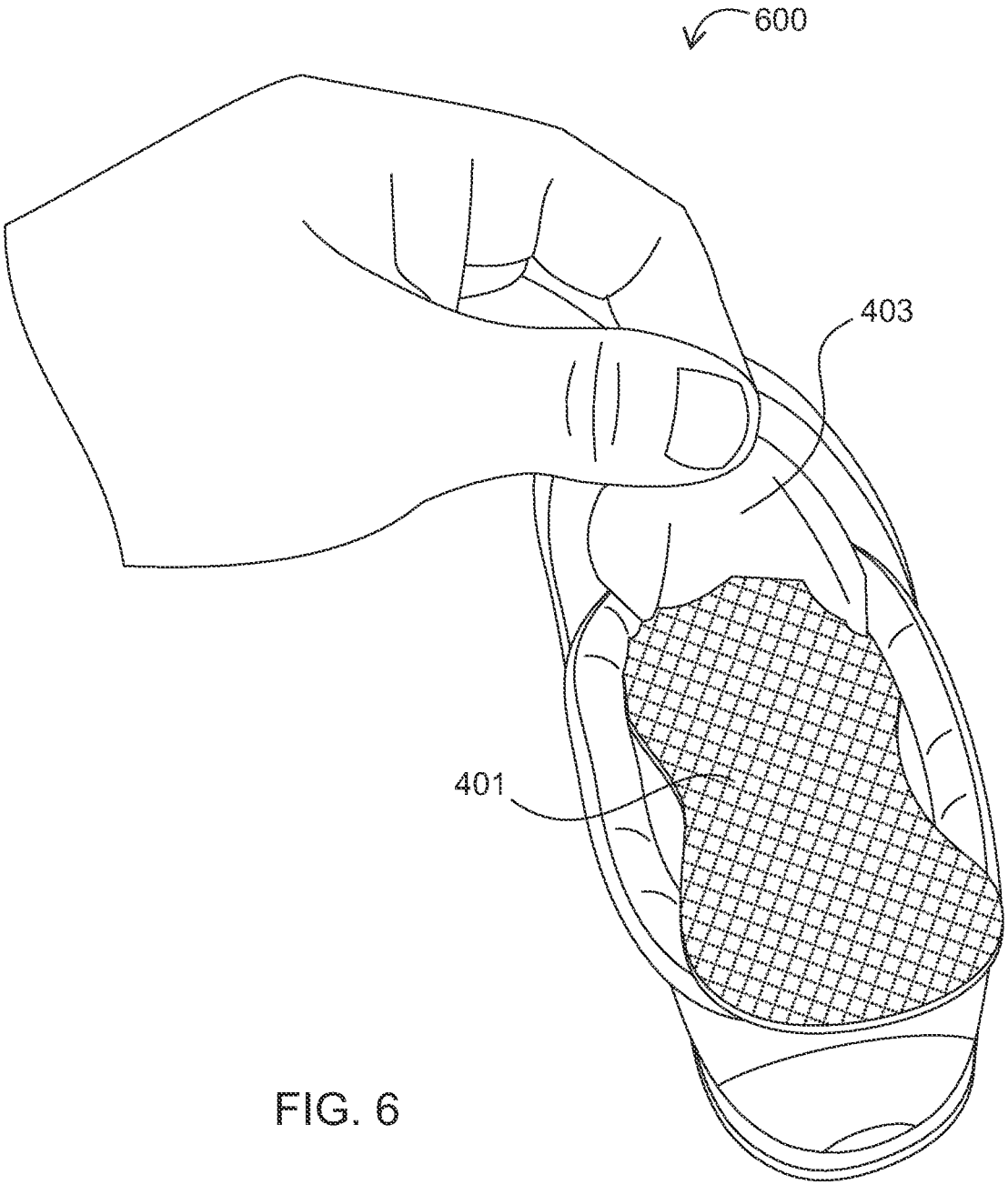
FIG. 6 illustrates the method of using 600 the shoe sizer kit, in accordance with an example embodiment.
Figure 7:
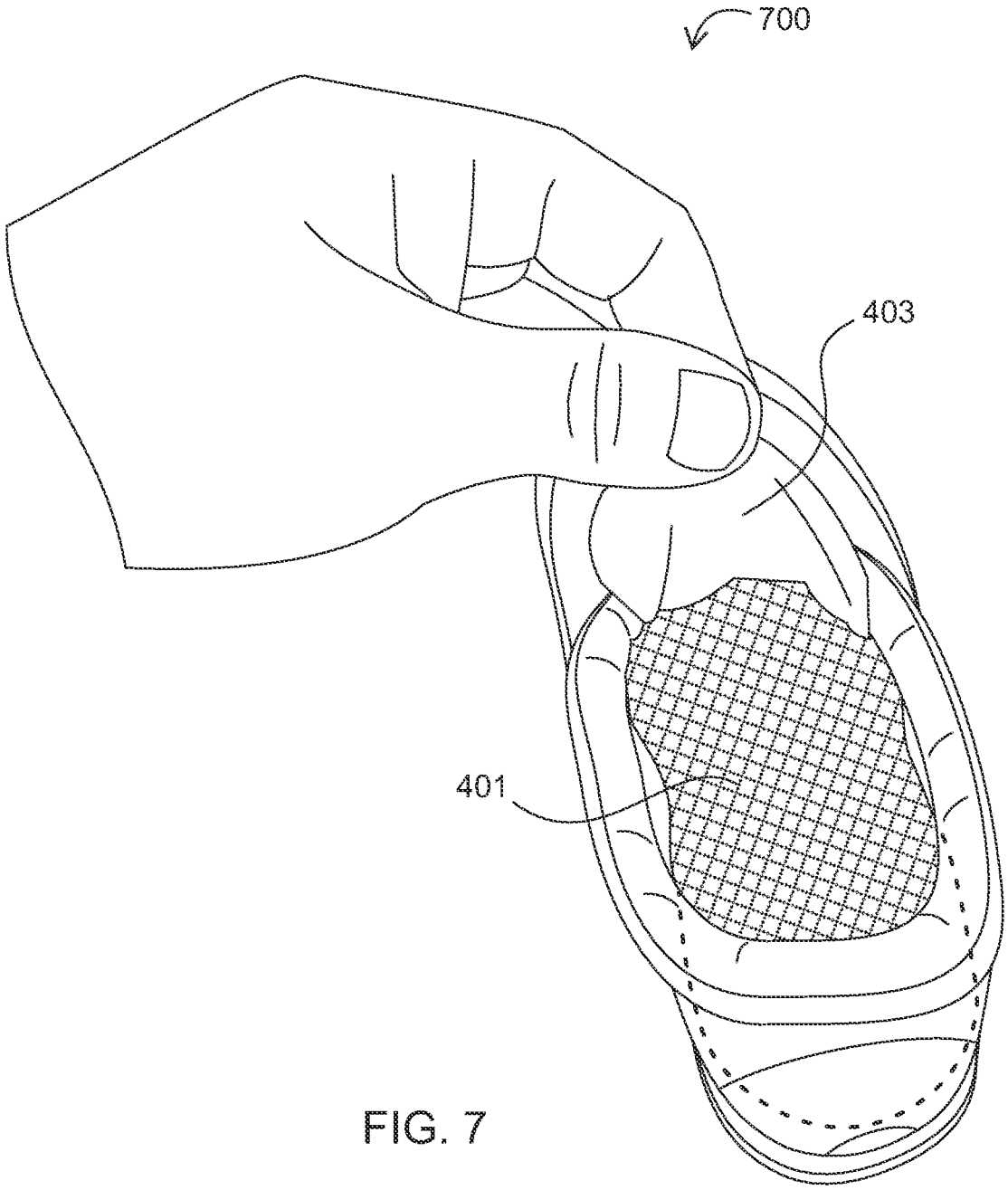
FIG. 7 illustrates the method of using 700 the shoe sizer kit, in accordance with an example embodiment.
Figure 8:
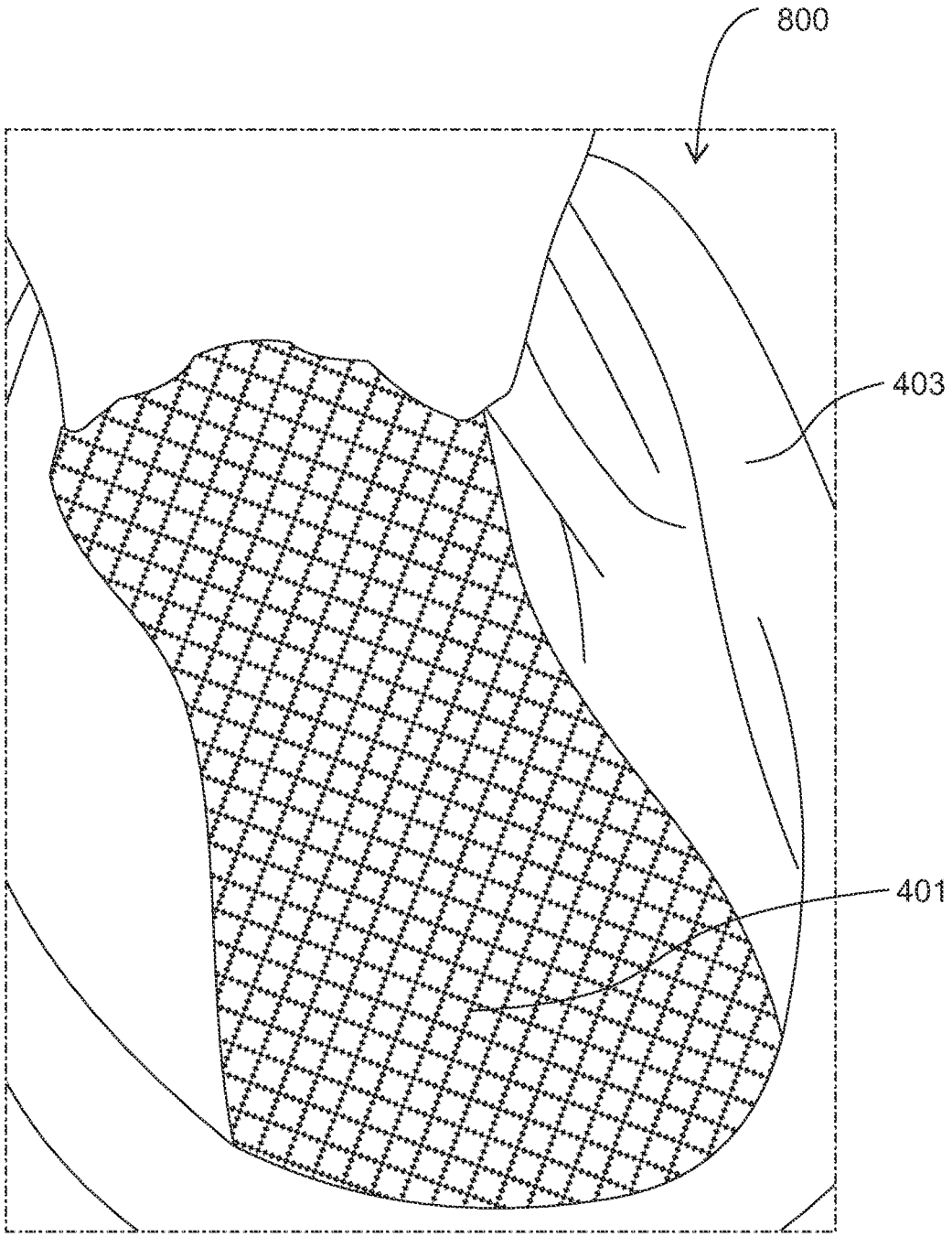
FIG. 8 illustrates the method of using 800 the shoe sizer kit, in accordance with an example embodiment.
Figure 9:
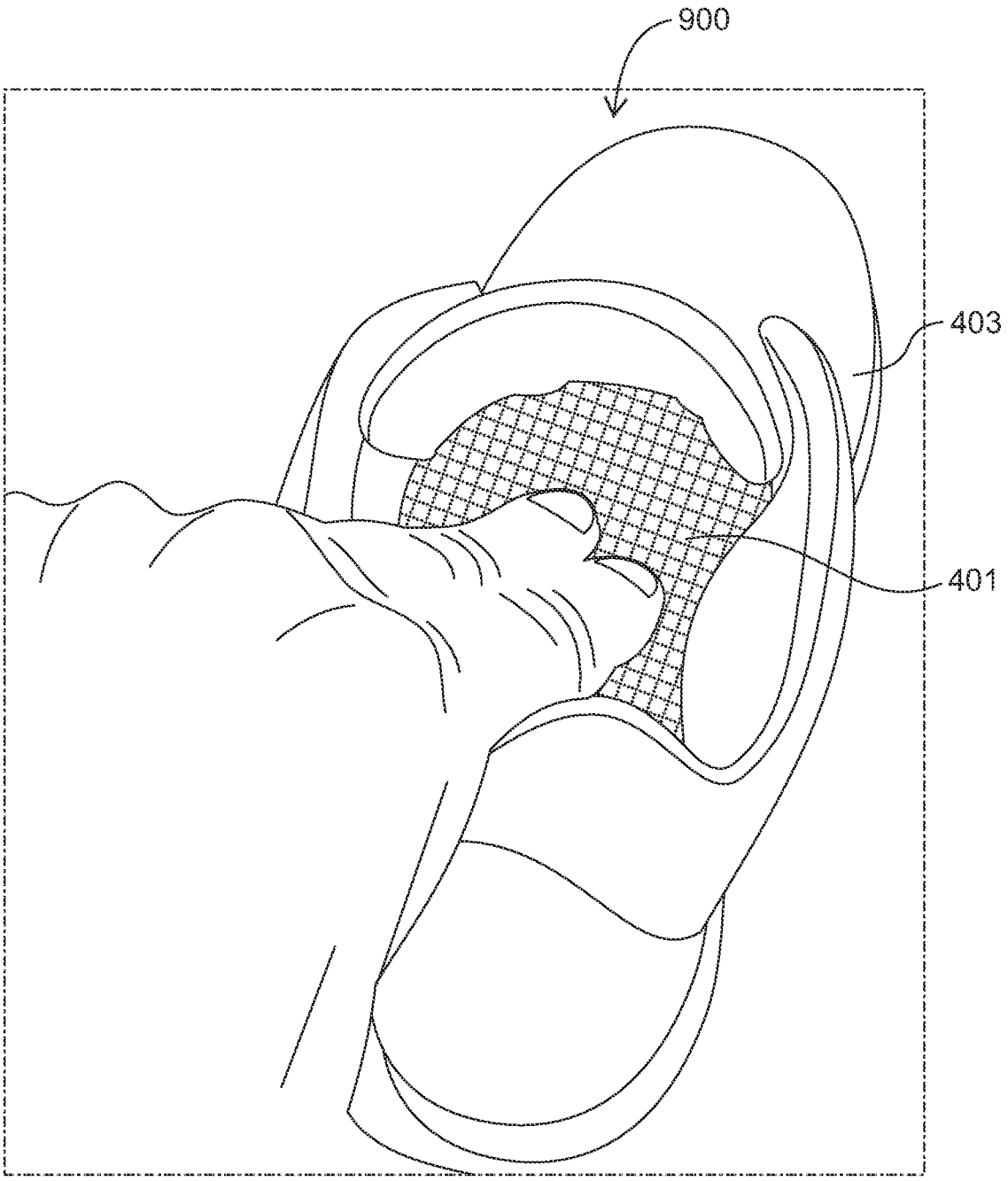
FIG. 9 illustrates the method of using 900 the shoe sizer kit, in accordance with an example embodiment.

Once the correct size of sizer 401 is chosen, take this sizer 401 to the store(s) and place it into the shoe 403 you are looking to purchase (as illustrated in methods 600, 700, and 800 in FIGS. 6, 7, and 8, respectively). Place your hand in the shoe 403 and feel where the sizer 401 ends (as illustrated in method 900 in FIG. 9). If the sizer 401 is too big for the shoe 403 or is touching the end of the inside of the shoe 403 by the toe area, then that size shoe 403 is not going to fit your child's foot 401. If the insert has a preferable ½ an inch space before touching the end of the shoe 403 by the toe area that you are looking to purchase, then that is the correct size shoe 403 that will fit your child's foot 401. (NOTE: This embodiment of the Children's Shoe Sizer only sizes that length of your child's foot. It does not claim to measure the height or width of your child's foot. The disclosed embodiments measure length of the child's foot and does not serve as an insole.)

This sizer 401 can also be used to measure current shoes your child(s) is wearing. One cannot always rely on children to tell when their toes are touching the end of their shoes. While following these same procedures above, one can determine if a child's current shoe(s) they are wearing are still the correct size or if you need to purchase new ones. The health of your child's foot for its natural growth is important and shoes should be checked regularly to prevent non-toe growth in your child(s) feet.

The inventor is the mother of two children, ages 4 and 9. The inventor struggles when it comes to buying her children new shoes. The appropriate size of her children's shoes is always a guessing game. She cannot rely on her children to be honest when she asks them, "Does that fit?" or "Is your toe touching?" Shoe buying for kids is daunting and most parents do not want to take their kids shoe shopping.

With the disclosed Children's Shoe Sizer, this takes the guess work out of buying shoes. Not all brands sizing are the same; some run too large or too small. Since every shoe cannot have a see through window to view the toes and we cannot rely on a child's judgment, this invention also prevents injury and non-growth to a child's growing foot. A user of the disclosed kit can size not only new shoes but check current shoes they are wearing as well.

Figure 10:
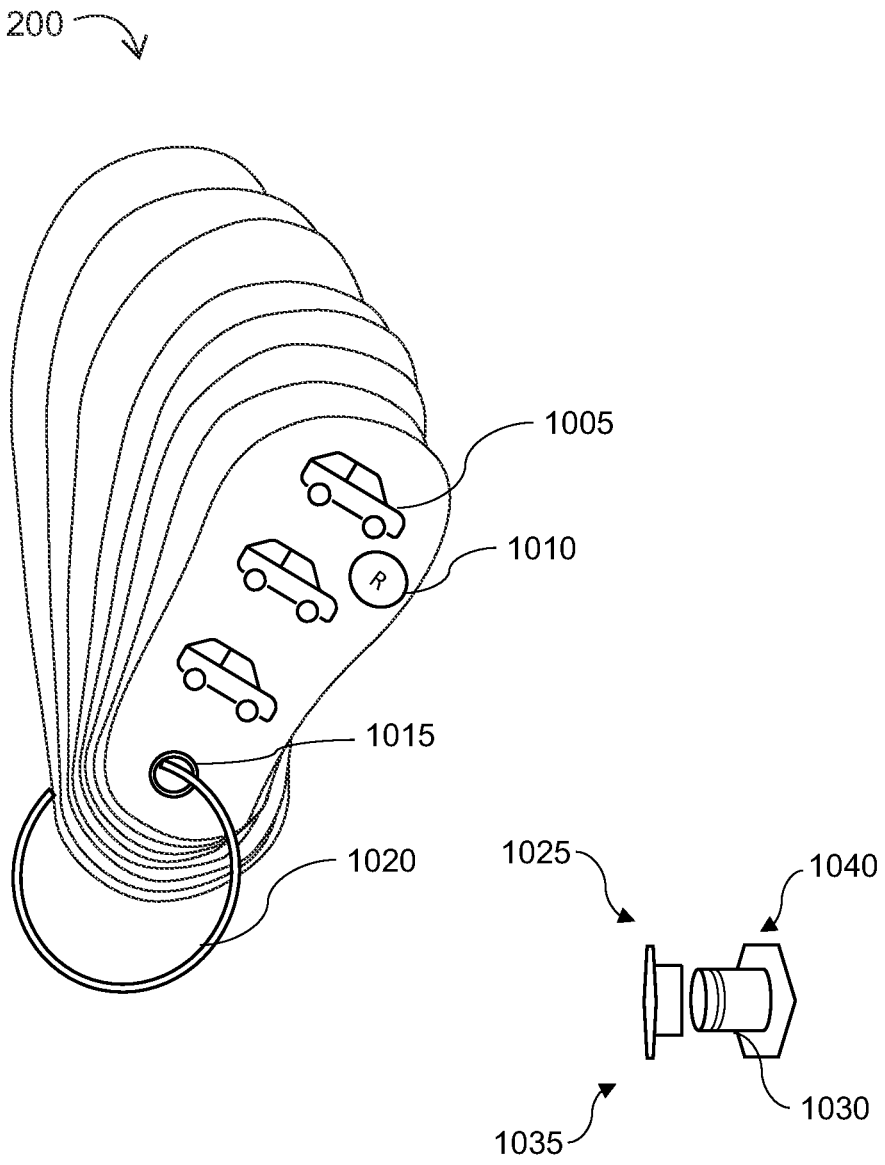
FIG. 10 illustrates a collection of shoe sizers for inclusion in a shoe sizing kit, in accordance with an example embodiment.

In other embodiments as illustrated in FIG. 10, the kit with shoe sizers 200 (or other embodiments, of the shoe sizer disclosed herein) can include color coding each of the respective shoe sizers 200 by size, to ease the task of identifying the size of the respective show sizer, among the shoe sizers 200. Likewise, a pattern 1005 can be printed on one or more of the shoe sizers 200 to correspond to size, and/or to indicate if the shoe sizer is sized for male shoe sizes or female shoe sizes. For example, the pattern 1005 could comprise a dinosaur, cars, superheroes, unicorns, princess, rainbows, etc. In certain embodiments, the size of the specific shoe sizer can alternatively or additionally be provided on each respective shoe sizer. An identifier 1010 can be printed on each respective show sizer to identify whether the sizer is configured for a left foot or a right foot. The identifier 1010 can comprise the words "LEFT," "RIGHT," the letters "L," or "R" or other such identifiers.

FIG. 10 further illustrates a hole 1015 punched into the shoe sizers 200. The hole 1015 can be configured to allow a hook or closable loop 1020 to be inserted through all the shoe sizers 200 in the kit so that they can be kept together. In addition, a clip 1025 can be provided. The clip 1025 can include a peg 1030 sized to fit through the hole 1015. The clip peg 1030 can be inserted through the hole and then the receiving end 1035 of the clip can be joined to the inserting end 1040 of the clip 1025. The clip 1025 can thus be used to hold the set of sizers together.

Figure 11A:
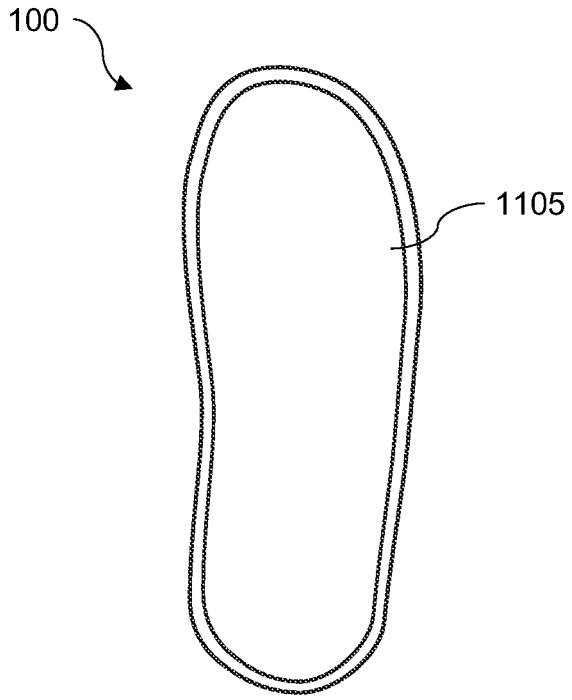
FIG. 11A illustrates an exemplary embodiment of a shoe sizer with contact paper layers in accordance with the disclosed embodiments.
Figure 11B:
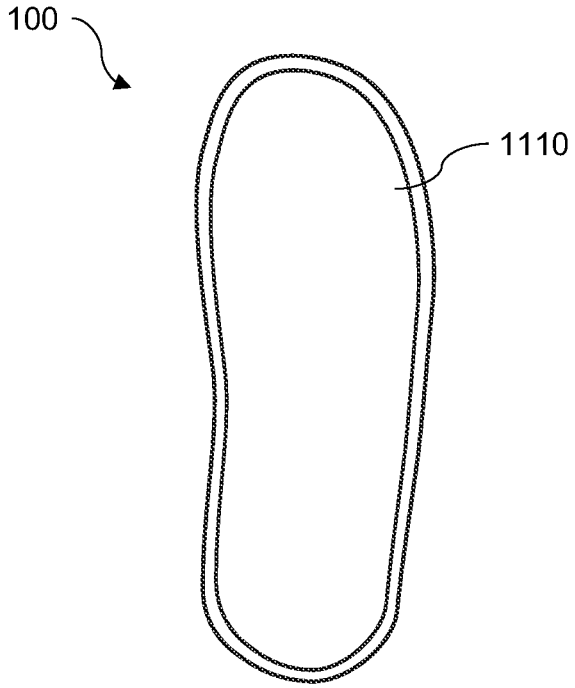
FIG. 11B illustrates an exemplary embodiment of a shoe sizer with ink layers in accordance with the disclosed embodiments.

FIG. 11A, illustrates further embodiments. FIG. 11 illustrates a sizer 100, but the embodiments in FIG. 11 can be included in other embodiments, disclosed herein. The one or more of the sizers 100 can include one or multiple layers of transfer material 1105. The transfer paper can be used to create an image of the user's foot on the sizer 100, that can be used for reference. In other embodiments, as illustrated in FIG. 11B, color changing ink 1110 can be used to create an impression of the foot on the sizer 100.

Figure 12:
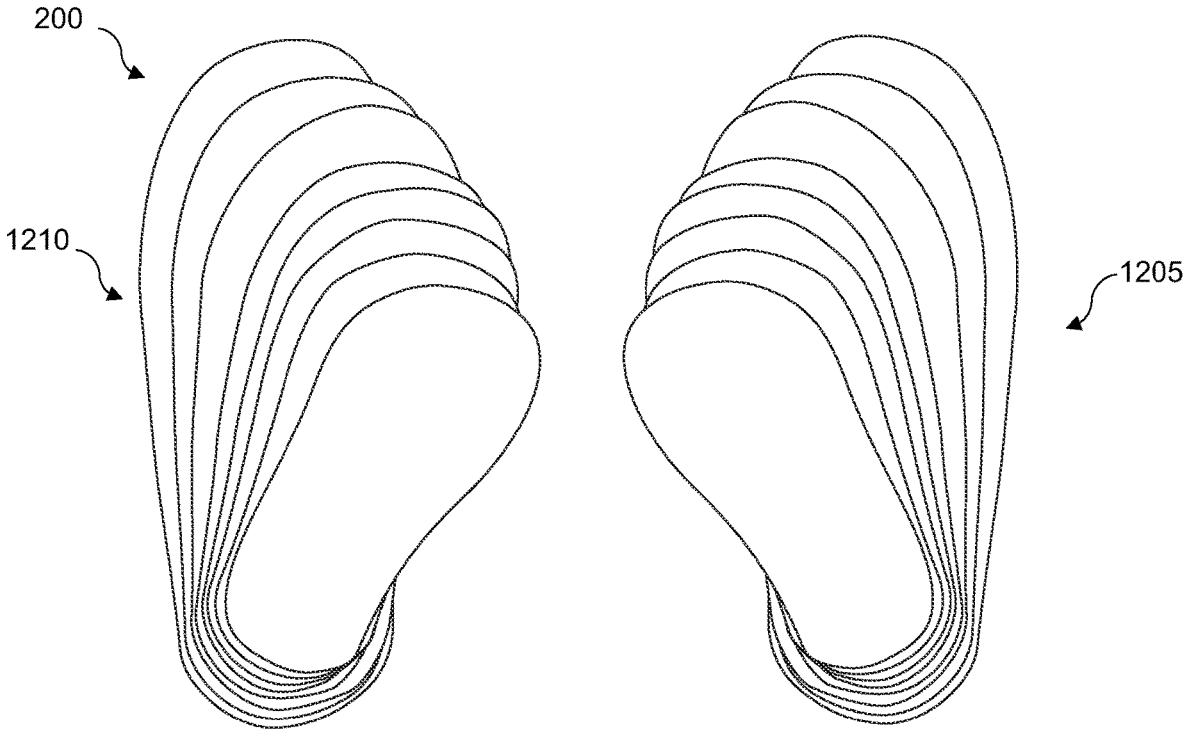
FIG. 12 illustrates a collection of right and left footed shoe sizers for inclusion in a shoe sizing kit, in accordance with an example embodiment.

FIG. 12 illustrates another embodiment in which the kit of can include shoe sizers 200 provided in sets for both a right foot 1205 for and a left foot 1210 for: Infant, Baby Walker, Toddler, Little Kid, and Big Kid. Sizes for Infant sizers include (United States Sizes): 0, 1, 1.5, 2, 2.5, 3, 3.5. Sizes for Baby Walker sizers include (United States Sizes): 4, 4.5, 5, 5.5, 6, 6.5, 7. Sizes for Toddler sizers include (United States Sizes): 7, 7.5, 8, 8.5, 9, 9.5, 10, 10.5, 11, 11.5, 12. Sizes for Little Kid sizers include (United States Sizes): 12, 12.5, 1, 1.5, 2, 2.5, 3. Sizes for Big Kid sizers include (United States Sizes): 3, 3.5, 4, 4.5, 5, 5.5, 6, 6.5, 7.

Figure 13:
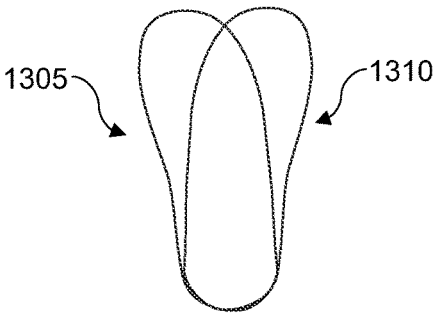
FIG. 13 illustrates an integrated right and left foot shoe sizer for inclusion in a shoe sizing kit, in accordance with an example embodiment.

In yet another embodiment, each shoe sizer 1300 can be configured with a left foot sizer and a right foot sizer, as illustrated in FIG. 13. In such an embodiment, one layer 1305 of the shoe sizer can comprise a right foot sizer, and the other layer 1310 can comprise a left foot sizer. It should be appreciated that, in such embodiments, each of the shoe sizer's 1300 in the shoe sizer kit, as illustrated in FIG. 2, can be configured with two layers as illustrated in FIG. 13.

Figure 14:
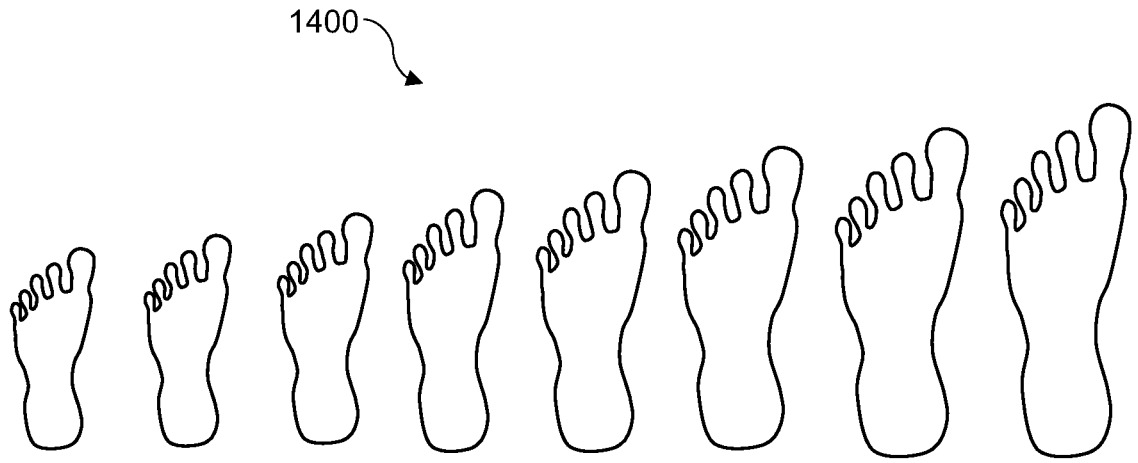
FIG. 14 illustrates a variety of foot shaped shoe sizers 1400, which can be implemented in accordance with an example embodiment.

In another embodiment shoe sizing kit, can include shoe sizers 1400 (as shown in FIG. 14) in a variety of shoe sizes along with instructions on properly sizing a child's foot. The shoe sizers 1400 can be constructed of durable material such as, for example, foam, foam rubber, polymer, plastic, or paper. And can be configured in the shape of a foot. As in other embodiments, the shoe sizing kit can come in five packages with all whole and half sizes in each package. In certain embodiments, the kit can also comprise a set of wide shoe sizers, a set of regular width shoe sizers, and a set of narrow shoe sizers. The kit includes shoe for: Infant, Baby Walker, Toddler, Little Kid, and Big Kid. Sizes for Infant sizers include (United States Sizes): 0, 1, 1.5, 2, 2.5, 3, 3.5. Sizes for Baby Walker sizers include (United States Sizes): 4, 4.5, 5, 5.5, 6, 6.5, 7. Sizes for Toddler sizers include (United States Sizes): 7, 7.5, 8, 8.5, 9, 9.5, 10, 10.5, 11, 11.5, 12. Sizes for Little Kid sizers include (United States Sizes): 12, 12.5, 1, 1.5, 2, 2.5, 3. Sizes for Big Kid sizers include (United States Sizes): 3, 3.5, 4, 4.5, 5, 5.5, 6, 6.5, 7. The kit can have the size on each sizer also marked with L (Left) and R (Right). Each kit of sizers can come in a carrying container, preferably a small clear carrying bag with handle for easy transport to stores, as illustrated in FIG. 3. The carrying container can also include: a package, a plastic bag, a box, or a bag with a handle.

Figure 15A:
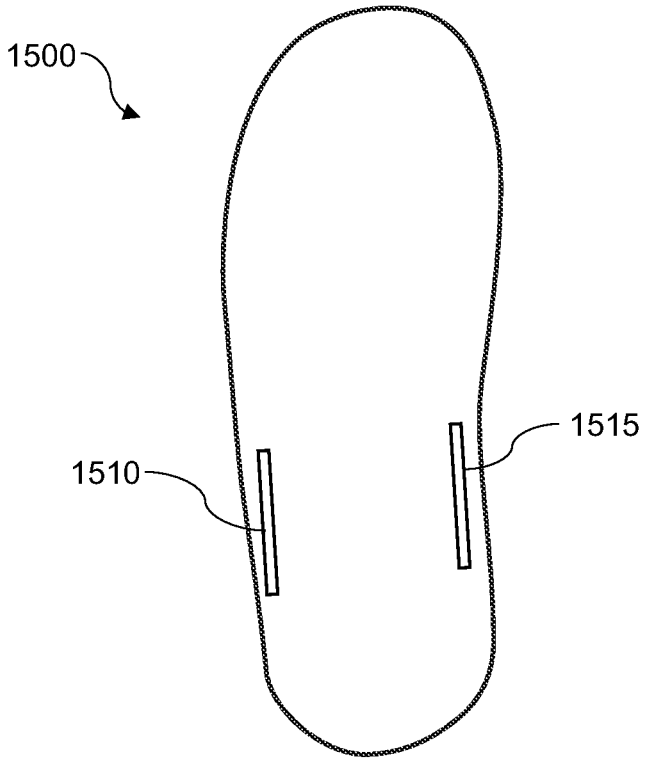
FIG. 15A illustrates a height measuring assembly, which can be implemented in accordance with an example embodiment.
Figure 15B:
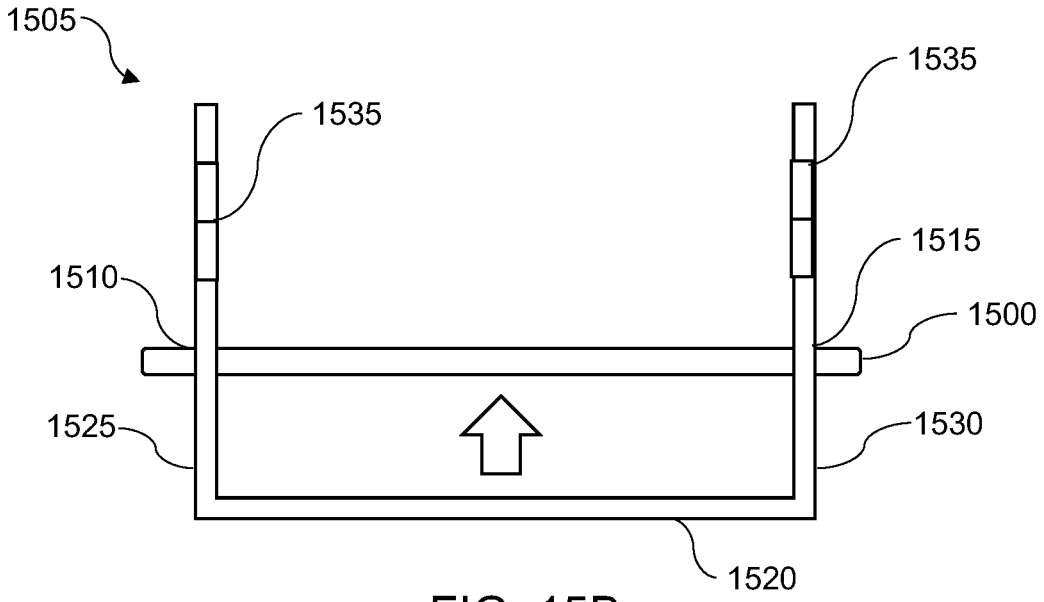
FIG. 15B illustrates a height measuring assembly, which can be implemented in accordance with an example embodiment.

In another embodiment, a height measuring assembly 1505 can be used in connection with a sizer 1500 as illustrated in FIG. 15A and FIG. 15B. As illustrated in FIG. 15A, the sizer 1500 can include a first slit 1510 and a second slit 1515. The slits can be configured along opposing edges of the sizer 1500. The measuring assembly 1505, as illustrated in elevation in FIG. 15B, can comprise a flat bottom base 1520 connected to a riser 1525. In certain embodiments, a single riser 1525 can be provided. In other embodiments, a riser can be connected to each end of the flat bottom platform 1520, including riser 1525, and riser 1530. The risers 1525 and 1530 can be inserted through first slit 1510 and second slit 1515 respectively.

The risers 1525 and 1530 can include graduations 1535. The graduations can be used to identify the height of the foot on the sizer 1500. In certain embodiments, multiple sets of slit locations can be provided on the sizer to determine the height of the user's foot at various locations.

Figure 16A:
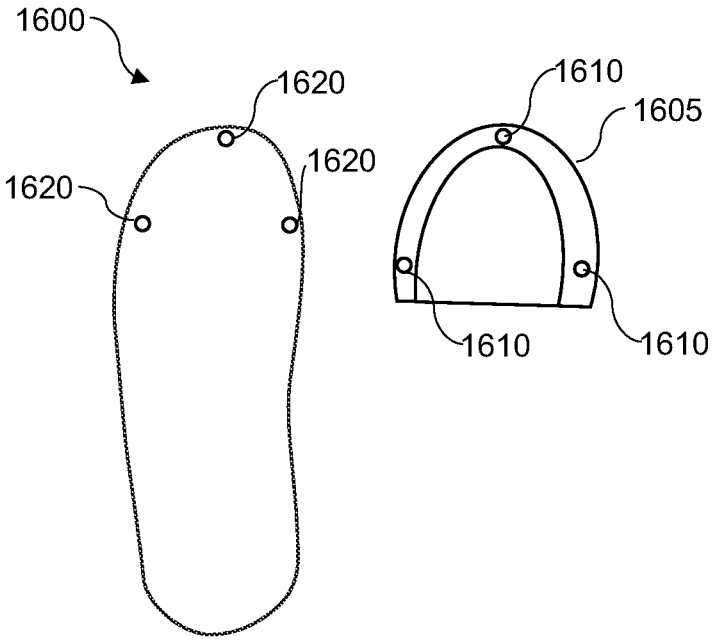
FIG. 16A illustrates a toe dome assembly associated with a shoe sizer, which can be implemented in accordance with an example embodiment.
Figure 16B:
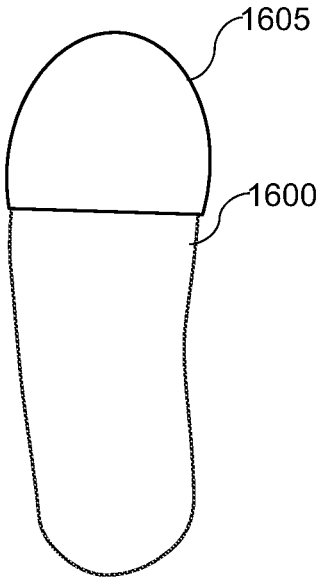
FIG. 16B illustrates a toe dome assembly associated with a shoe sizer, which can be implemented in accordance with an example embodiment.

FIG. 16 illustrates another embodiment of a system comprising a sizer 1600, which can incorporate some or all features of other embodiments described herein. The sizer 1600, can further include a plurality of mounting holes 1620 configured to interface with a toe shield 1605. The toe shield 1605 can comprise a domed shape configured to fit on the sizer 1600. The toe shield 1605 can be installed on the sizer 1600 over parts of the user's foot and/or toes. The toe shield further comprises a series of pegs 1610 configured to fit through the mounting holes 1620 on the sizer 1600.

Based on the foregoing, it can be appreciated that a number of embodiments, preferred and alternative, are disclosed herein. In an embodiment, a shoe sizing kit is disclosed. The shoe sizing kit comprises: a plurality of shoe sizers shaped in a plurality of shoe sizes and shaped to size a foot; instructions for using the plurality of shoe sizers; and a carrying container for the plurality of shoe sizers and the instructions. In yet another embodiment, the plurality of shoe sizers are shaped to measure a foot size of a child.

In other embodiments, the plurality of shoe sizers comprises seven sizers, wherein the plurality of shoe sizers are shaped to measure a foot size of an infant, wherein the plurality of shoe sizers are shaped in infant shoe sizes: 0, 1, 1.5, 2, 2.5, 3, 3.5. In an embodiment, the plurality of shoe sizers comprises seven sizers, wherein the plurality of shoe sizers are shaped to measure a foot size of a baby walker, wherein the plurality of shoe sizers are shaped in baby walker shoe sizes: 4, 4.5, 5, 5.5, 6, 6.5, 7. In some embodiments, the plurality of shoe sizers comprises eleven sizers, wherein the plurality of shoe sizers are shaped to measure a foot size of a toddler, wherein the plurality of shoe sizers are shaped in toddler shoe sizes: 7, 7.5, 8, 8.5, 9, 9.5, 10, 10.5, 11, 11.5, 12. In another embodiment, the plurality of shoe sizers comprises seven sizers, wherein the plurality of shoe sizers are shaped to measure a foot size of a little kid, wherein the plurality of shoe sizers are shaped in little kid shoe sizes: 12, 12.5, 1, 1.5, 2, 2.5, 3. In other embodiments, the plurality of shoe sizers comprises nine sizers, wherein the plurality of shoe sizers are shaped to measure a foot size of a big kid, wherein the plurality of shoe sizers are shaped in big kid shoe sizes: 3, 3.5, 4, 4.5, 5, 5.5, 6, 6.5, 7.

In yet another embodiment, the plurality of shoe sizers are marked on one side with "Left" to measure a left foot; and the plurality of shoe sizers are marked on one side with "Right" to measure a right foot. In other embodiments, the plurality of sizers comprise at least one of: foam, foam rubber, polymer, plastic, or paper. In some embodiments, the instructions for using the plurality of shoe sizers advise: select one of the plurality of sizers that corresponds to a size of a right foot of a child; have the child step down with the right foot on one of the plurality of sizers to determine a size of the right foot of the child; turn over the one of the plurality of sizers to measure a left foot or select another one of the plurality of sizers that corresponds to a size of the left foot of the child; have the child step down with the left foot on one of the plurality of sizers to determine a size of the left foot of the child; insert the selected one of the plurality of sizers into a shoe to determine if the shoe fits the right foot of the child, wherein the shoe fits the right foot if the selected one of the plurality of sizers does not touch the end of the shoe; insert the selected one of the plurality of sizers into a shoe to determine if the shoe fits the left foot of the child, wherein the shoe fits the left foot if the selected one of the plurality of sizers does not touch the end of the shoe; select the shoe for the right foot if the one of the plurality of sizes fits with space between the one of the plurality of sizers and the end of the shoe; and select the shoe for the left foot if the one of the plurality of sizes fits with space between the one of the plurality of sizers and the end of the shoe.

In another embodiment, the carrying container comprises a package, a plastic bag, a box, or a bag with a handle.

In an embodiment, a shoe sizing system comprises: a plurality of shoe sizers shaped in a plurality of shoe sizes and shaped to size a foot a plurality of shoe sizers shaped in a plurality of shoe sizes and shaped to size a foot of a child; and a shoe that receives one of the plurality of shoe sizers when inserted into the shoe, wherein the one of the plurality of shoe sizers corresponds to a size of a foot of the child and correctly determines if the shoe fits the foot of the child. In some embodiments, the plurality of shoe sizers comprises seven sizers, wherein the plurality of shoe sizers shaped to measure a foot size of an infant, wherein the plurality of shoe sizers are shaped in infant shoe sizes: 0, 1, 1.5, 2, 2.5, 3, 3.5. In another embodiment, the plurality of shoe sizers comprises seven sizers, wherein the plurality of shoe sizers are shaped to measure a foot size of a baby walker, wherein the plurality of shoe sizers are shaped in baby walker shoe sizes: 4, 4.5, 5, 5.5, 6, 6.5, 7. In other embodiments, the plurality of shoe sizers comprises eleven sizers, wherein the plurality of shoe sizers are shaped to measure a foot size of a toddler, wherein the plurality of shoe sizers are shaped in toddler shoe sizes: 7, 7.5, 8, 8.5, 9, 9.5, 10, 10.5, 11, 11.5, 12. In yet another embodiment, the plurality of shoe sizers comprises seven sizers, wherein the plurality of shoe sizers are shaped to measure a foot size of a little kid, wherein the plurality of shoe sizers are shaped in little kid shoe sizes: 12, 12.5, 1, 1.5, 2, 2.5, 3. In other embodiments, the plurality of shoe sizers comprises nine sizers, wherein the plurality of shoe sizers are shaped to measure a foot size of a big kid, wherein the plurality of shoe sizers are shaped in big kid shoe sizes: 3, 3.5, 4, 4.5, 5, 5.5, 6, 6.5, 7.

In other embodiments, the plurality of shoe sizers are marked on one side with "Left" to measure a left foot; the plurality of shoe sizers are marked on one side with "Right" to measure a right foot; and the plurality of sizers comprise at least one of: foam, foam rubber, polymer, plastic, or paper.

In an embodiment, a shoe sizing method is disclosed. The method comprises: selecting one of the plurality of sizers that corresponds to a size of a right foot of a child; having the child step down with the right foot on one of the plurality of sizers to determine a size of the right foot of the child; turning over the one of the plurality of sizers to measure a left foot or select another one of the plurality of sizers that corresponds to a size of the left foot of the child; and having the child step down with the left foot on one of the plurality of sizers to determine a size of the left foot of the child.

In another embodiment, the method comprises: inserting the selected one of the plurality of sizers into a shoe to determine if the shoe fits the right foot of the child, wherein the shoe fits the right foot if the selected one of the plurality of sizers does not touch the end of the shoe; inserting the selected one of the plurality of sizers into a shoe to determine if the shoe fits the left foot of the child, wherein the shoe fits the left foot if the selected one of the plurality of sizers does not touch the end of the shoe; selecting the shoe for the right foot if the one of the plurality of sizes fits within the shoe with space between the one of the plurality of sizers and the end of the shoe; and selecting the shoe for the left foot if the one of the plurality of sizes fits within the shoe with space between the one of the plurality of sizers and the end of the shoe.

It will be appreciated that variations of the above-disclosed and other features and functions, or alternatives thereof, may be desirably combined into many other different systems or applications. Also, it should be understood that various presently unforeseen or unanticipated alternatives, modifications, variations or improvements therein may be subsequently made by those skilled in the art which are also intended to be encompassed by the following claims.

What is claimed is:

1. A shoe sizing kit comprising:

a plurality of child shoe sizers in a plurality of child shoe sizes configured to size a child's foot, wherein each of the plurality of child shoe sizers is configured to be matched to a child's foot size external to a shoe, and then inserted into the shoe, while the shoe is not being worn, in order to determine if the shoe will fit;

instructions for using the plurality of shoe sizers; and a carrying container for the plurality of shoe sizers and the instructions.

2. The shoe sizing kit of claim 1 wherein the plurality of child shoe sizers are configured to measure a shoe of a child.

3. The shoe sizing kit of claim 1 wherein the plurality of child shoe sizers arc shaped to measure a foot size of an infant, wherein the plurality of child shoe sizers are configured in infant shoe sizes: 0, 1, 1.5, 2, 2.5, 3, 3.5.

4. The shoe sizing kit of claim 1 wherein the plurality of child shoe sizers measure a foot size of a baby walker, wherein the plurality of child shoe sizers are configured in baby walker shoe sizes: 4, 4.5, 5, 5.5, 6, 6.5, 7.

5. The shoe sizing kit of claim 1 wherein the plurality of child shoe sizers measure a foot size of a toddler, wherein the plurality of child shoe sizers are configured in toddler shoe sizes: 7, 7.5, 8, 8.5, 9, 9.5, 10, 10.5, 11, 11.5, 12.

6. The shoe sizing kit of claim 1 wherein the plurality of child shoe sizers comprises seven sizers, wherein the plurality of child shoe sizers measure a foot size of a little kid, wherein the plurality of shoe sizers are configured in little kid shoe sizes: 12, 12.5, 1, 1.5, 2, 2.5, 3.

7. The shoe sizing kit of claim 1 wherein the plurality of child shoe sizers comprises nine sizers, wherein the plurality of child shoe sizers measure a foot size of a big kid, wherein the plurality of child shoe sizers are configured in big kid shoe sizes: 3, 3.5, 4, 4.5, 5, 5.5, 6, 6.5, 7.

8. The shoe sizing kit of claim 1 wherein:

each of the plurality of child shoe sizers are configured to measure a left foot on one side; and each of the plurality of child shoe sizers are configured to measure a right foot on an opposing side.

9. The shoe sizing kit of claim 8 wherein the one side configured to measure a left foot is identified as for a left foot; and the opposing side configured to measure a right foot is identified as for a right foot.

10. The shoe sizing kit of claim 1 wherein the plurality of child shoe sizers comprise at least one of: foam, foam rubber, polymer, plastic, or paper.

11. The shoe sizing kit of claim 1 wherein the instructions for using the plurality of child shoe sizers advise:

have the child step down with the right foot on one of the plurality of child shoe sizers to determine a size of the right foot of the child;

have the child step down with the left foot on one of the plurality of child shoe sizers to determine a size of the left foot of the child;

insert the selected one of the plurality of child shoe sizers into a shoe to determine if the shoe fits the right foot of the child;

insert the selected one of the plurality of child shoe sizers into a shoe to determine if the shoe fits the left foot of the child.

12. A shoe sizing system comprising:

a plurality of shoe sizers configured in a plurality of pre-set shoe sizes to size a foot wherein each of the plurality of shoe sizers is configured to be matched to a foot size external to a shoe, and then inserted into the shoe, while the shoe is not being worn, in order to determine if the shoe will fit;

wherein one of the plurality of shoe sizers corresponds to a size of a foot and correctly indicates if the shoe fits the foot.

13. The shoe sizing system of claim 12 wherein the plurality of shoe sizers measure a foot size of an infant, wherein the plurality of shoe sizers are configured in infant shoe sizes: 0, 1, 1.5, 2, 2.5, 3, 3.5.

14. The shoe sizing system of claim 12 wherein the plurality of shoe sizers measure a foot size of a baby walker, wherein the plurality of shoe sizers are configured in baby walker shoe sizes: 4, 4.5, 5, 5.5, 6, 6.5, 7.

15. The shoe sizing system of claim 12 wherein the plurality of shoe sizers measure a foot size of a toddler, wherein the plurality of shoe sizers are configured in toddler shoe sizes: 7, 7.5, 8, 8.5, 9, 9.5, 10, 10.5, 11, 11.5, 12.

16. The shoe sizing system of claim 12 wherein the plurality of shoe sizers comprises seven sizers, wherein the plurality of shoe sizers measure a foot size of a little kid, wherein the plurality of shoe sizers are configured in little kid shoe sizes: 12, 12.5, 1, 1.5, 2, 2.5, 3.

17. The shoe sizing system of claim 12 wherein the plurality of shoe sizers comprises nine sizers, wherein the plurality of shoe sizers measure a foot size of a big kid, wherein the plurality of shoe sizers are configured in big kid shoe sizes: 3, 3.5, 4, 4.5, 5, 5.5, 6, 6.5, 7.

18. The shoe sizing system of claim 12 wherein:

the plurality of shoe sizers are marked on one side with "Left" to measure a left foot;

the plurality of shoe sizers are marked on one side with "Right" to measure a right foot; and the plurality of sizers comprise at least one of: foam, foam rubber, polymer, and plastic.

19. A shoe sizing method comprising:

configuring a plurality of child shoe sizers that corresponds to a size of a right foot on one side, and a size of a left foot on an opposite side;

selecting one of the plurality of child shoe sizers that correctly identifies a size of the right foot of the child, by comparing the right foot of the child to the plurality of child shoe sizers, external to a right foot shoe;

selecting one of the plurality of child shoe sizers that correctly identifies a size of the left foot of the child, by comparing the left foot of the child to the plurality of child shoe sizers, external to a left foot shoe;

inserting the selected right foot child shoe sizer into the right foot shoe to determine if the right foot shoe fits the right foot; and inserting the selected left foot child shoe sizer into the left foot shoe to determine if the left foot shoe fits the left foot.

20. The shoe sizing method of claim 19 further comprising:

selecting the right foot shoe if the selected child shoe sizer fits within the right foot shoe; and selecting the left foot shoe if the selected child shoe sizer fits within the left foot shoe.

* * * * *